US005672123A

United States Patent [19]

Rudell et al.

[11] Patent Number: 5,672,123

[45] Date of Patent: Sep. 30, 1997

[54] WATER MAT ACTIVITY WITH PUDDLES AND SPRAY ACTION

[75] Inventors: Elliot Rudell, Torrance; Joseph Cernansky, Palos Verdes Estates, both of Calif.

[73] Assignee: Elliot A. Rudell, Torrance, Calif.

[21] Appl. No.: 571,199

[22] Filed: Dec. 12, 1995

[51] Int. Cl.[6] ..... A63B 67/00

[52] U.S. Cl. ..... 473/414; 273/457; 473/466

[58] Field of Search ..... 273/457, 350; 473/414, 466

[56] References Cited

U.S. PATENT DOCUMENTS

| | | | |
|---|---|---|---|
| 3,139,281 | 6/1964 | Nicholson | 473/414 |
| 3,895,801 | 7/1975 | Baird | 273/358 |
| 4,185,819 | 1/1980 | Hardley | 473/414 |
| 4,733,864 | 3/1988 | Casteel | 473/414 |
| 4,982,959 | 1/1991 | Rudell et al. | 273/443 |
| 5,318,307 | 6/1994 | Bouchard et al. | 273/350 X |

*Primary Examiner*—William H. Grieb

*Attorney, Agent, or Firm*—Blakely Sokoloff Taylor & Zafman

[57] ABSTRACT

A water game that has a mat and a wall which define a reservoir that holds a volume of water. The reservoir may be separated into a plurality of individual compartments. The wall has a height that allows children to hop in and out of the reservoir. The base mat has a plurality of indicia located in separate blocked areas of the mat. The indicia are arranged so that the participants can jump about the mat in accordance with the rules of the game hopscotch. The wall may be inflated with water and contain apertures that continuously emit streams of water onto the mat area of the game to fill and replenish the reservoir.

5 Claims, 1 Drawing Sheet

FIG. 1
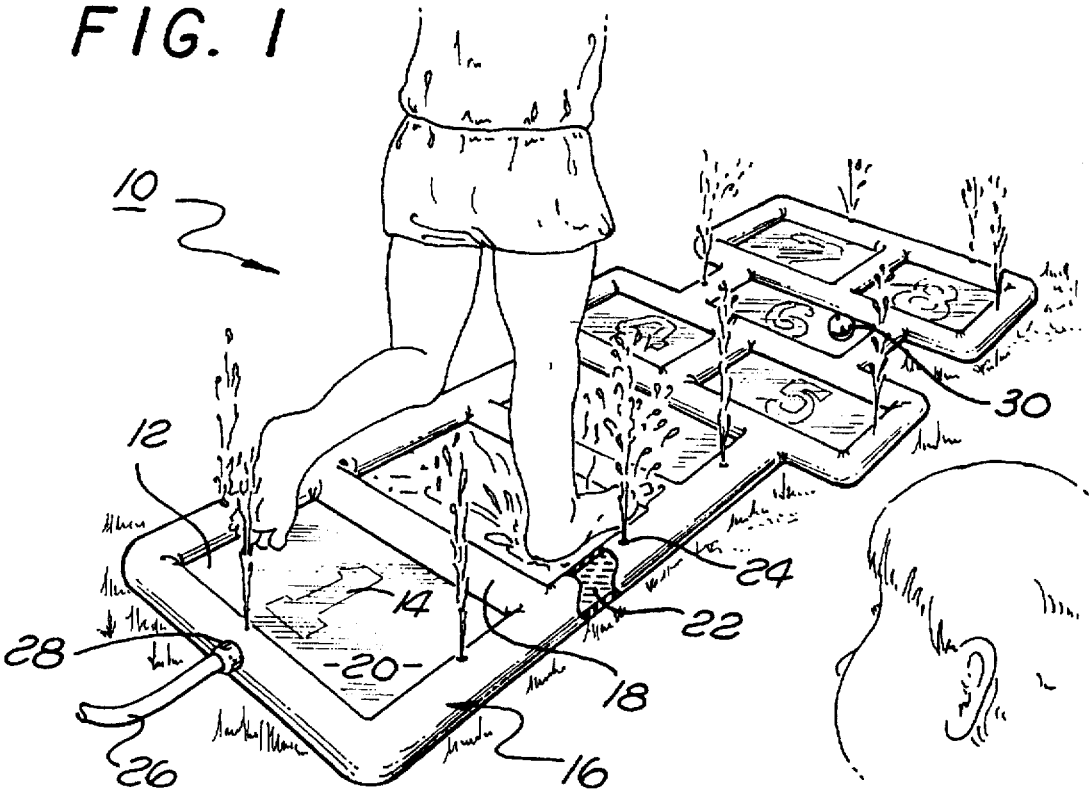
FIG. 2
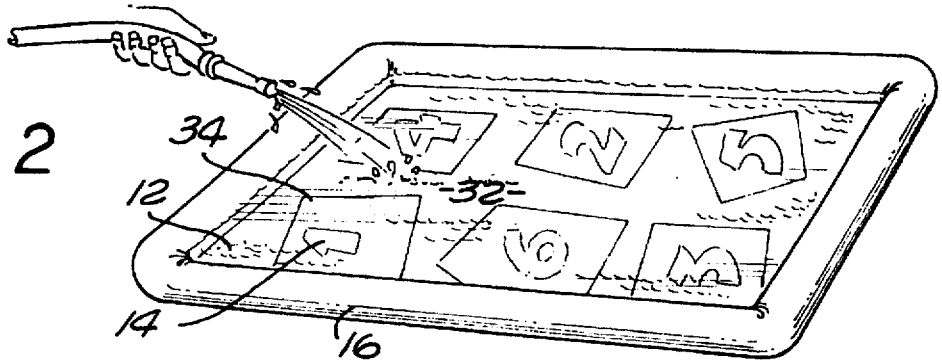
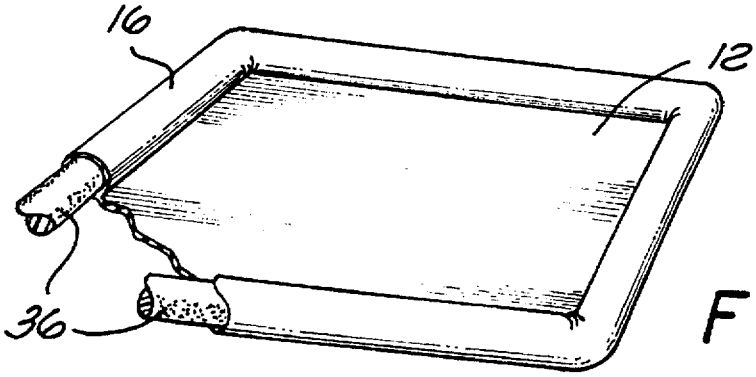
FIG. 3

WATER MAT ACTIVITY WITH PUDDLES AND SPRAY ACTION

BACKGROUND OF THE INVENTION

1. Field of the Invention

The present invention relates to a water mat used to play the game of hopscotch.

2. Description of Related Art

There have been marketed water slide games, such as SLIP N'SLIDE marketed by Whamo-O Manufacturers and SURF SLIDER marketed by Marchon, which include a vinyl mat that can be placed onto a lawn and covered with water. The participants then run across the lawn and slide on the mat. Although fun to play, water slide games have been found to result in injuries to the players. In particular it has been found that children have separated shoulders when running and sliding across the mat.

U.S. Pat. No. 4,982,959 issued to Rudell discloses a game which is being marketed by Larami Corporation under the trademark SUPER SOAKER TWISTER. This product is comprised of a game mat constructed from two heat-sealed vinyl panels that create narrow water passageways. A garden hose is attached to the mat, and pressurized water travels through the passageways and up though small apertures onto a generally flat gamemat surface. The water exits the apertures as fountain-like streams. Numerous position-indicating indicia on the top surface designate areas onto which the players must participate in the classic game of twister, which involves placing hands and feet in different areas, while straddling and contorting their limbs around other players. SUPER SOAKER TWISTER adds the extra dimension of spraying the children as they play the game, thereby improving the original indoor party game by transforming it into an outdoor summer game where the children can get wet in the sprinkler aspect of the invention.

It would be desirable to provide a water game which requires a certain level of physical skill. Additionally, it would be desirable to provide a game that allowed children to play in water puddles.

SUMMARY OF THE INVENTION

The present invention is a water game that has a mat and a wall which define a reservoir that holds a volume of water. The reservoir may be separated into a plurality of individual compartments. The wall has a height that allows children to hop in and out of the reservoir. The base mat has a plurality of indicia located in separate blocked areas of the mat. The indicia are arranged so that the participants can jump about the mat in accordance with the rules of the game hopscotch. The wall may be inflated with water and contain apertures that continuously emit streams of water onto the mat area of the game to fill and replenish the reservoir.

BRIEF DESCRIPTION OF THE DRAWINGS

The objects and advantages of the present invention will become more readily apparent to those ordinarily skilled in the art after reviewing the following detailed description and accompanying drawings, wherein:

FIG. 1 is a perspective view of a water game of the present invention;

FIG. 2 is an alternate embodiment of the water game of FIG. 1;

FIG. 3 is an alternate embodiment of the water game of FIG. 1.

DETAILED DESCRIPTION OF THE INVENTION

Referring to the drawings more particularly by reference numbers, FIG. 1 shows a water game 10 of the present invention. The game 10 allows participants to play the game of hopscotch in a "wet" environment. Hopscotch is typically played by drawing a number of boxes and corresponding numbers onto a hard surface. Each player must hop into the boxes, being careful to only have one foot in one box. The players must successfully hop in a sequence of boxes in a forward and reverse direction. A token or ball may be thrown into one of the boxes to define the limit of travel.

The game includes a base mat 12 that has a plurality of indicia 14 formed on a top surface of the mat 12. Attached to the base mat 12 is an outer wall 16 that can capture water on top of the mat 12. The wall 16 may have a number of sections 18 which extend across the base mat 12 and divide the mat 12 into a plurality of compartments 20. Each compartment 20 preferably has a separate numerical indicia 14. The compartments 20 and indicia 14 are arranged in a pattern that allow the participants to play a game of hopscotch. The pattern may include a row of three individual compartments, marked with the numbers 1–3, followed by a pair of compartments 20 marked with the numbers 4 and 5, respectively. The pattern may further include a single compartment marked with the number 6, followed by a pair of compartments marked with the numbers 7 and 8, respectively.

The wall 16 may have an inner passage 22 that is inflated with water. The wall 16 may also have a plurality of apertures 24 that allow water to spray onto the players and flow from the inner passage 22 to the mat 12. A garden hose 26 may be attached to a nozzle 28 of the wall 16 to provide a continuous flow of water into the inner passage 22 and onto the mat 12. The continuous flow of water replenishes the water that is splashed out of the compartments 20 when the players hop across the mat 12.

The mat 12 and wall 16 are preferably constructed from a material such as polyvinyl chloride ("PVC"). The wall 16 may be attached to the mat 12 by a heat seal process, a solvent bonding adhesive, or a sonic welding process. The game is preferably at least 24 inches wide and 36 inches long.

To play a game, a garden hose 26 is attached to the nozzle 28 and running water is provided to the inner passage 22 of the wall 16. The compartments 20 are filled with a level of water so that the game of "wet hopscotch" can be played by the players. The compartments 20 may be filled by water emitted from the apertures 24, or by filling the compartments 20 with the garden hose 26 before attaching the hose 26 to the nozzle 28. Each player may then throw a token 30 into one of the compartments 20. The player then hops to the compartment that contains the token 30, removes the token 30, and then hops back to the starting point.

In the preferred embodiment, the players throw and remove the tokens sequentially from the compartments 20. For example, each player throws, hops and removes the token from the compartment with the numeral 1, then throws, hops and removes the token from the compartment with the numeral 2, and so forth and so on. The compartments form puddles which splash water when stepped into by the players and thus increase the amusement of playing the game.

Although separate compartments 20 can be defined by the wall sections 18, as shown in FIG. 2, the game may have a single reservoir 32 defined by a single outer wall 16. The indicia 14 may be located within printed blocks 34 on the surface of the mat 12. Such a game may be manually filled with the hose 26 instead of providing a continuous supply of water. Additionally, although a wall 16 with apertures 24 is shown and described, it is to be understood that the game may not have apertures 24 that release water. The wall 16 has a relatively low height so that children can easily jump in and out of the reservoir 32. The water within the reservoir provides a puddle that splashes water onto the children and increases the entertainment value of the game. In the preferred embodiment, the height of the wall should not exceed 4 inches.

As shown in FIG. 3, the inner passage 22 may contain a foam material 36 that provides structural rigidity to the wall 16. The foam 36 may be either an open or closed cell wall 16. Additionally, the inner passage 22 of the wall 16 may also be inflated with air instead of water.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A water game, comprising:

a mat; and, a wall that is attached to said mat to create a plurality of reservoir compartments which retain a fluid, wherein said wall includes an inner passage which contains the fluid and a plurality of apertures that allow fluid to flow from said inner passage into said reservoir compartments.

2. The game as recited in claim 1, wherein said compartments each contain an indicia.

3. The game as recited in claim 2, wherein said indicia include a first numeral in a first compartment and a second numeral in a second compartment.

4. The game as recited in claim 1, wherein said wall includes a nozzle that is attached to a hose.

5. The game as recited in claim 1, wherein said wall is filled with a foam material.

* * * * *